US011306990B2

(12) United States Patent
Hull

(10) Patent No.: US 11,306,990 B2
(45) Date of Patent: Apr. 19, 2022

(54) SYSTEMS AND METHODS FOR COUPLING A BARREL AND HANDGUARD TO A FIREARM

(71) Applicant: Shilen Rifles, Inc., Ennis, TX (US)

(72) Inventor: Robert Wade Hull, Ennis, TX (US)

(73) Assignee: Shilen Rifles, Inc., Ennis, TX (US)

( * ) Notice: Subject to any disclaimer, the term of this patent is extended or adjusted under 35 U.S.C. 154(b) by 122 days.

(21) Appl. No.: 16/694,617

(22) Filed: Nov. 25, 2019

(65) Prior Publication Data

US 2020/0284543 A1 Sep. 10, 2020

Related U.S. Application Data

(60) Provisional application No. 62/813,967, filed on Mar. 5, 2019.

(51) Int. Cl.
*F41A 21/48* (2006.01)

(52) U.S. Cl.
CPC ..... *F41A 21/482* (2013.01)

(58) Field of Classification Search
CPC ..... F41A 21/482; F41A 21/48; F41A 5/18; F41C 23/16; F41G 11/003
USPC ..... 42/71.01, 75.01–75.1
See application file for complete search history.

(56) References Cited

U.S. PATENT DOCUMENTS 2,685,754 A * 8/1954 Crittendon ..... F41C 7/02 42/16
5,412,895 A * 5/1995 Krieger ..... F41A 21/482 42/75.02
6,499,245 B1 * 12/2002 Swan ..... F41C 23/00 42/71.01
6,671,990 B1 * 1/2004 Booth ..... F41C 23/16 42/75.01
7,458,179 B2 * 12/2008 Swan ..... F41G 11/003 42/105
7,716,865 B2 * 5/2010 Daniel ..... F41C 23/16 42/75.02
7,770,317 B1 * 8/2010 Tankersley ..... F41C 23/16 42/71.01
8,141,285 B2 * 3/2012 Brown ..... F41C 23/16 42/71.01
8,141,289 B2 * 3/2012 Gomez ..... F41C 23/16 42/90
8,251,051 B2 * 8/2012 Maggiore ..... F41B 11/62 124/76
8,276,303 B2 * 10/2012 Kapusta ..... F41G 11/003 42/71.01
8,448,367 B2 * 5/2013 Samson ..... F41A 13/12 42/75.02

(Continued)

*Primary Examiner* — Michael D David
(74) *Attorney, Agent, or Firm* — K&L Gates LLP

(57) ABSTRACT

Systems and methods for coupling a barrel to a firearm are disclosed, including firearms incorporating the systems. In an embodiment, the firearm includes a receiver including a cavity and an internal thread disposed within the cavity. In addition, the firearm includes a barrel including a first threaded connector that is threadably engaged with the internal thread within the cavity and a second threaded connector. Further, the firearm includes a barrel nut including an internal thread and an external thread. The internal thread of the barrel nut is threadably engaged with the second threaded connector of the barrel.

17 Claims, 5 Drawing Sheets

(56) References Cited

U.S. PATENT DOCUMENTS 8,453,364 B2 * 6/2013 Kucynko ..... F41C 23/16 42/71.01
8,782,943 B2 * 7/2014 Jarboe ..... F41A 21/482 42/75.02
8,904,691 B1 * 12/2014 Kincel ..... F41C 23/16 42/71.01
9,140,506 B2 * 9/2015 Gomez ..... F41C 23/20
9,322,609 B2 * 4/2016 Davies ..... F41A 5/18
9,389,043 B1 * 7/2016 Zhang ..... F41C 23/16
D764,620 S * 8/2016 Packard ..... D22/104
9,423,194 B2 * 8/2016 Fritz ..... F41A 3/66
9,476,672 B2 * 10/2016 Wells ..... F41G 11/003
D815,710 S * 4/2018 Packard ..... D22/103
9,995,557 B2 * 6/2018 Geissele ..... F41C 23/16
10,126,095 B1 * 11/2018 Reid ..... F41A 21/485
10,145,648 B1 * 12/2018 Holder ..... F41C 23/16
10,295,304 B1 * 5/2019 Kincel ..... F41A 21/485
10,309,747 B2 * 6/2019 Samson ..... F41C 23/16
10,401,122 B2 * 9/2019 Williams ..... F41G 11/003
2003/0230022 A1 * 12/2003 Battaglia ..... F41G 11/003 42/111
2004/0049964 A1 * 3/2004 Vais ..... F41A 21/482 42/75.02
2006/0065112 A1 * 3/2006 Kuczynko ..... F41A 5/28 89/193
2007/0017139 A1 * 1/2007 Larue ..... F41A 21/482 42/75.1
2010/0095575 A1 * 4/2010 Swan ..... F41C 23/16 42/72
2011/0126443 A1 * 6/2011 Sirois ..... F41G 11/003 42/90
2011/0192066 A1 * 8/2011 Kimmel ..... F41C 23/16 42/71.01
2011/0247254 A1 * 10/2011 Barnes ..... F41A 21/48 42/71.01
2012/0324775 A1 * 12/2012 Troy ..... F41C 23/16 42/71.01
2013/0180151 A1 * 7/2013 Moore ..... F41C 27/00 42/90
2014/0075817 A1 * 3/2014 Gomez ..... F16B 37/00 42/75.02
2016/0025120 A1 * 1/2016 Swan ..... F41G 11/003 248/231.31
2016/0054096 A1 * 2/2016 Dzwill ..... F41A 21/48 42/75.02
2016/0169617 A1 * 6/2016 Daley, Jr. ..... F41C 23/16 42/71.01
2016/0195350 A1 * 7/2016 Packard ..... F41A 9/55 42/6
2017/0097207 A1 * 4/2017 Hines ..... F41A 21/48
2019/0101355 A1 * 4/2019 Hubbell ..... F41C 23/16
2019/0226799 A1 * 7/2019 Hubbell ..... F41C 27/00

* cited by examiner

SYSTEMS AND METHODS FOR COUPLING A BARREL AND HANDGUARD TO A FIREARM

PRIORITY CLAIM

This application claims priority to U.S. Provisional Application No. 62/813,967, titled "SYSTEMS AND METHODS FOR COUPLING A BARREL AND HANDGUARD TO A FIREARM", filed Mar. 5, 2019, the entire contents of which are incorporated by reference and relied upon.

STATEMENT REGARDING FEDERALLY SPONSORED RESEARCH OR DEVELOPMENT

Not applicable.

BACKGROUND

Elongated firearms, such as rifles, may include a trigger mechanism and a forestock or handguard. Typically, the handguard extends along the longitudinal axis of the barrel. During shooting operations a user may grip the hand guard, or may rest the handguard on a support surface. In either case, engaging the handguard during shooting operations imparts additional stability and accuracy.

As arm length, hand size, and other anthropometric features vary from user to user, so too should the handguard. However, handguards are often permanently affixed to firearms during manufacturing. Alternatively, handguards are affixed semi-permanently, but in a way such that it is difficult, if not impossible, to easily remove and replace the handguard for customization purposes. The same can be said for handguard-less firearms. For example, the same difficulties may be experienced with barrel-only type systems.

Improved firearms and related methods for coupling a barrel to a firearm are therefore needed.

SUMMARY

The firearms and related methods disclosed herein improve on current technology, by providing new ways of coupling a barrel to a firearm.

In light of the disclosure, and without limiting the scope of the invention in any way, in a first aspect of the present disclosure, which may be combined with any other aspect listed herein unless specified otherwise, a firearm includes a receiver, a barrel, and a barrel nut. The receiver includes a cavity and an internal thread disposed within the cavity. The barrel includes a first threaded connector that is threadably engaged with the internal thread within the cavity and a second threaded connector spaced from the first threaded connector. The barrel nut includes an internal thread and an external thread. The internal thread of the barrel nut is threadably engaged with the second threaded connector of the barrel.

In a second aspect of the present disclosure, which may be combined with any other aspect listed herein unless specified otherwise, the barrel includes a central axis, a first end, and a second end. The first threaded connector and the second threaded connector are each disposed more axially proximate the second end than the first end.

In a third aspect of the present disclosure, which may be combined with any other aspect listed herein unless specified otherwise, the first threaded connector includes a first axial length and the second threaded connector includes a second axial length, and the first axial length is different from the second axial length.

In a fourth aspect of the present disclosure, which may be combined with any other aspect listed herein unless specified otherwise, the first threaded connector has a first external barrel thread, and the second threaded connector has a second external barrel thread. The first external barrel thread is different from the second external barrel thread.

In a fifth aspect of the present disclosure, which may be combined with any other aspect listed herein unless specified otherwise, the first external barrel thread has a first major diameter and the second thread has a second major diameter. The first major diameter is smaller than the second major diameter.

In a sixth aspect of the present disclosure, which may be combined with any other aspect listed herein unless specified otherwise, the firearm further includes a cylindrical surface extending axially from the first external barrel thread of the first threaded connector to the second external barrel thread of the second threaded connector.

In a seventh aspect of the present disclosure, which may be combined with any other aspect listed herein unless specified otherwise, the barrel nut includes a first end and a second end opposite the first end. The internal thread of the barrel nut is more proximate the second end than the first end.

In an eighth aspect of the present disclosure, which may be combined with any other aspect listed herein unless specified otherwise, the external thread of the barrel nut is more proximate the second end than the first end.

In a ninth aspect of the present disclosure, which may be combined with any other aspect listed herein unless specified otherwise, the barrel nut further includes a plurality of circumferentially spaced recesses extending radially inward to a radially outer surface of the barrel nut.

In a tenth aspect of the present disclosure, which may be combined with any other aspect listed herein unless specified otherwise, the recesses extend axially from the first end of the barrel nut.

In an eleventh aspect of the present disclosure, which may be combined with any other aspect listed herein unless specified otherwise, the firearm further includes a handguard disposed about the barrel and including an internal thread that is threadably engaged with the external thread of the barrel nut.

In a twelfth aspect of the present disclosure, which may be combined with any other aspect listed herein unless specified otherwise, a firearm includes a receiver, a barrel, and a barrel nut. The receiver includes a cavity and an internal thread disposed within the cavity. The barrel includes a first threaded connector that is threadably engaged with the internal thread within the cavity and a second threaded connector. The first threaded connector includes a first external barrel thread, and the second threaded connector includes a second external barrel thread that is different from the first external barrel thread. The barrel nut includes an internal thread. The internal thread of the barrel nut is threadably engaged with the second threaded connector of the barrel.

In a thirteenth aspect of the present disclosure, which may be combined with any other aspect listed herein unless specified otherwise, the barrel includes a central axis, a first end, and a second end. The first threaded connector and the second threaded connectors are each disposed more axially proximate the second end than the first end.

In a fourteenth aspect of the present disclosure, which may be combined with any other aspect listed herein unless specified otherwise, the first threaded connector includes a first axial length and the second threaded connector includes a second axial length. The first axial length is different from the second axial length.

In a fifteenth aspect of the present disclosure, which may be combined with any other aspect listed herein unless specified otherwise, the first external barrel thread has a first major diameter and the second thread has a second major diameter. The first major diameter is smaller than the second major diameter.

In a sixteenth aspect of the present disclosure, which may be combined with any other aspect listed herein unless specified otherwise, the barrel nut includes a first end and a second end opposite the first end of the barrel nut. The internal thread of the barrel nut is more proximate the second end of the barrel nut than the first end of the barrel nut.

In a seventeenth aspect of the present disclosure, which may be combined with any other aspect listed herein unless specified otherwise, the barrel nut further includes a plurality of circumferentially spaced recesses extending radially inward to a radially outer surface of the barrel nut, and extending axially from the first end of the barrel nut.

In an eighteenth aspect of the present disclosure, which may be combined with any other aspect listed herein unless specified otherwise, a method of coupling a barrel and a handguard to a firearm includes (a) threadably engaging a first threaded connector of the barrel with an internal thread disposed within a cavity of a receiver of the firearm, (b) threadably engaging an internal thread of a barrel nut with a second threaded connector of the barrel that is spaced form the first threaded connector, (c) tensioning the barrel during (b), and (d) threadably engaging an internal thread of the handguard with an external thread of the barrel nut.

In a nineteenth aspect of the present disclosure, which may be combined with any other aspect listed herein unless specified otherwise, (a) includes threadably engaging a first external thread of the first threaded connector of the barrel with the internal thread disposed within the cavity of the receiver, and (b) includes threadably engaging the internal thread of the barrel nut with a second external thread of the second threaded connector.

In a twentieth aspect of the present disclosure, which may be combined with any other aspect listed herein unless specified otherwise, (b) and (c) include engaging a plurality of recesses formed on the barrel nut with a spanner wrench.

Additional features and advantages of the disclosed devices, systems, and methods are described in, and will be apparent from, the following Detailed Description and the Figures. The features and advantages described herein are not all-inclusive and, in particular, many additional features and advantages will be apparent to one of ordinary skill in the art in view of the figures and description. Also, any particular embodiment does not have to have all of the advantages listed herein. Moreover, it should be noted that the language used in the specification has been selected for readability and instructional purposes, and not to limit the scope of the inventive subject matter.

BRIEF DESCRIPTION OF THE FIGURES

Understanding that figures depict only typical embodiments of the invention and are not to be considered to be limiting the scope of the present disclosure, the present disclosure is described and explained with additional specificity and detail through the use of the accompanying figures. The figures are listed below.

DETAILED DESCRIPTION

Figure 1:
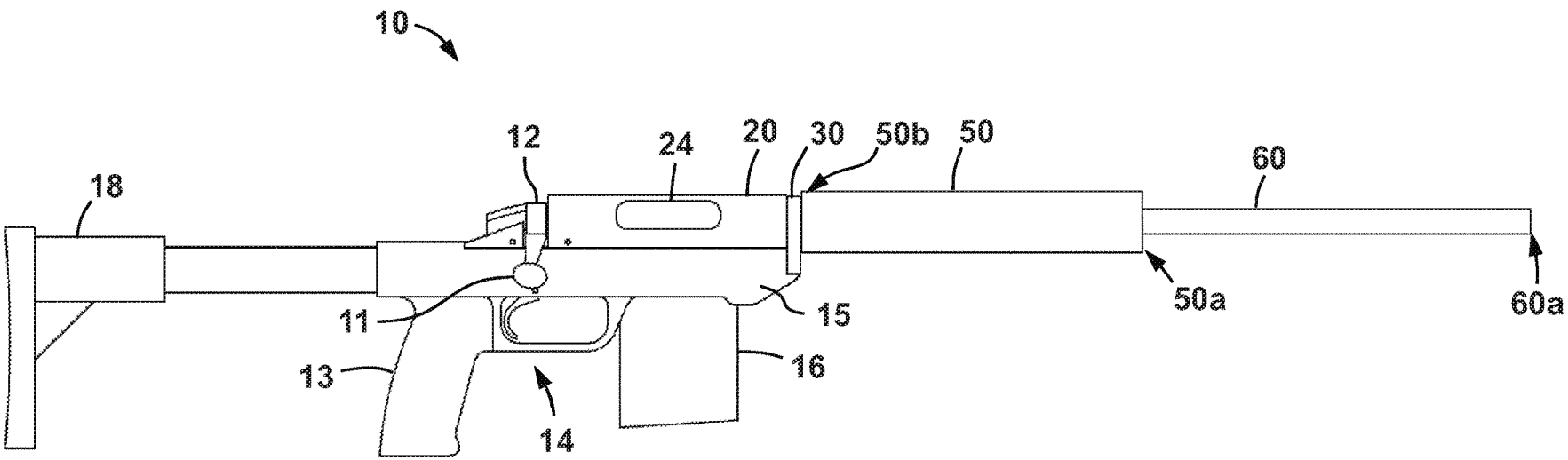
FIG. 1 is side view of a rifle according an example embodiment of the present disclosure.

The following discussion is directed to various exemplary embodiments. However, one of ordinary skill in the art will understand that the examples disclosed herein have broad application, and that the discussion of any embodiment is meant only to be exemplary of that embodiment, and not intended to suggest that the scope of the disclosure, including the claims, is limited to that embodiment.

The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection of the two devices, or through an indirect connection that is established via other devices, components, nodes, and connections. In addition, as used herein, the terms "axial" and "axially" generally mean along or parallel to a given axis (e.g., central axis of a body or a port), while the terms "radial" and "radially" generally mean perpendicular to the given axis. For instance, an axial distance refers to a distance measured along or parallel to the axis, and a radial distance means a distance measured perpendicular to the axis. Further, when used herein (including in the claims), the words "about," "generally," "substantially," "approximately," and the like mean within a range of plus or minus 10%.

As previously described above, a rifle may include a handguard that is gripped by a hand of a user or is placed upon a support surface during shooting operations to provide stability and accuracy. To further ensure accuracy, it is typically desirable to avoid excessive contact between the barrel and the handguard such that the barrel is essentially cantilevered (or "free floating") from (or proximate to) its connection at the receiver to the muzzle. In particular, such excessive contact between the handguard and barrel (particularly at points that are distal from the connection between the receiver and barrel) may cause loads to be transferred to the barrel during aiming and shooting operations such that the flight path of the projectile fired from the rifle may be altered from the desired course. In addition, often it may be desirable to outfit a rifle with customized, interchangeable parts so as to provide a user with an ability to customize the rifle as desired. Accordingly, embodiments disclosed herein include systems and methods for coupling a barrel and handguard to a firearm (e.g., a rifle) that allow the handguard to be interchangeably installed thereon while allowing the barrel to remain free floating.

Referring now to FIG. 1, a rifle 10 is shown. In this embodiment, rifle 10 is a chassis-style bolt-action rifle that includes a manually actuated bolt 12 that is movably disposed within a receiver 20. In addition, rifle 10 includes a rear stock 18, a grip 13, and a trigger assembly 14 adjacent to grip 13. Receiver 20, rear stock 18, grip 13, and trigger assembly 14 are all mounted to a central chassis or frame 15. Further, rifle 10 includes a barrel 60 and handguard 50 (or forend) each coupled to receiver 20 in a manner described in more detail below.

Generally speaking, during shooting operations, a user (not shown) engages a first hand with the grip 13 such that one or more fingers of the first hand may access the trigger assembly 14, and engages the stock 18 into one shoulder (e.g., the shoulder that is on the same side of the user's body as the first hand). In addition, the user may engage the hand guard with a second, opposite hand and/or may engage handguard 50 with a suitable support surface or rest so as to provide stability and support to the barrel 60.

Figure 2:
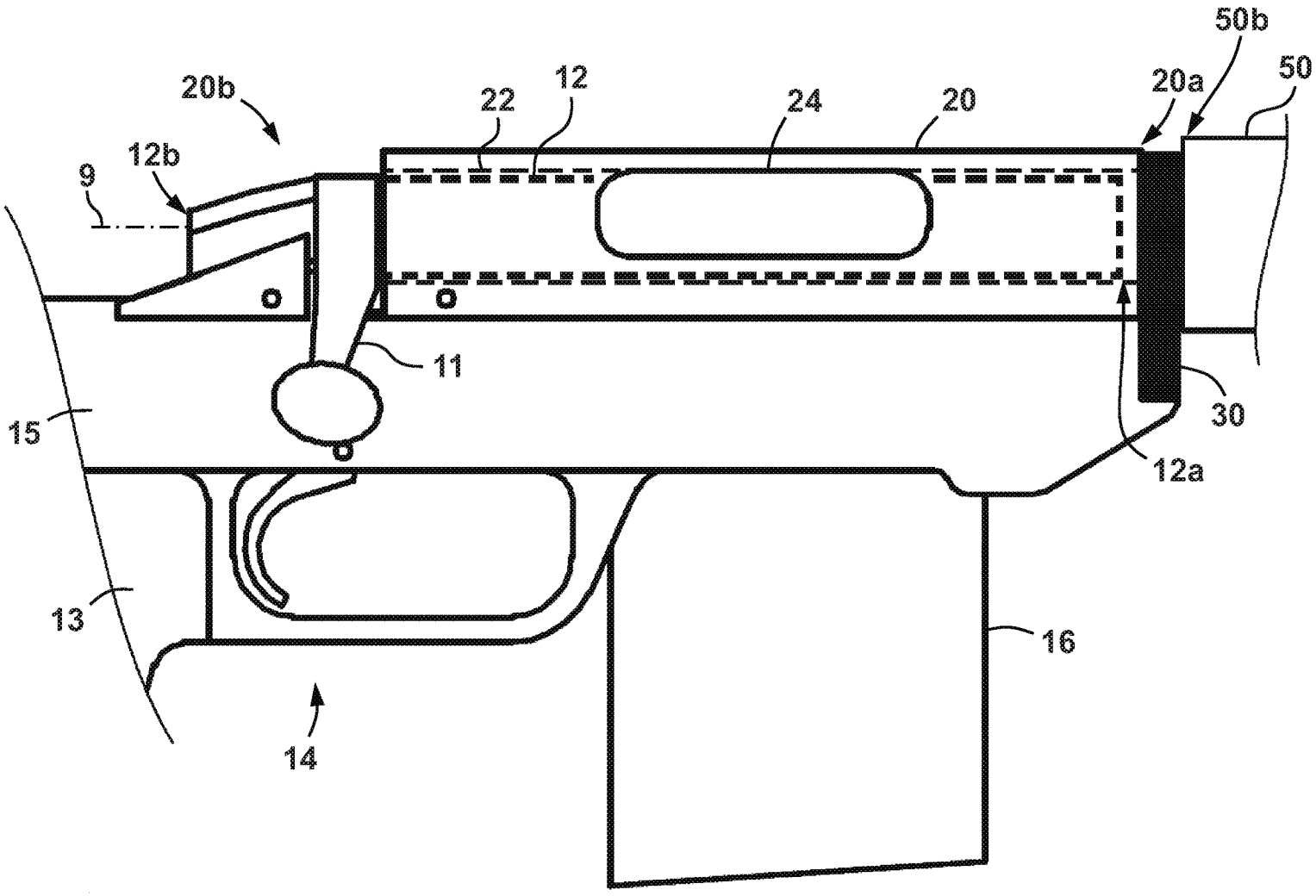
FIG. 2 is an enlarged side view of the rifle of FIG. 1, according to an example embodiment of the present disclosure.
Figure 4:
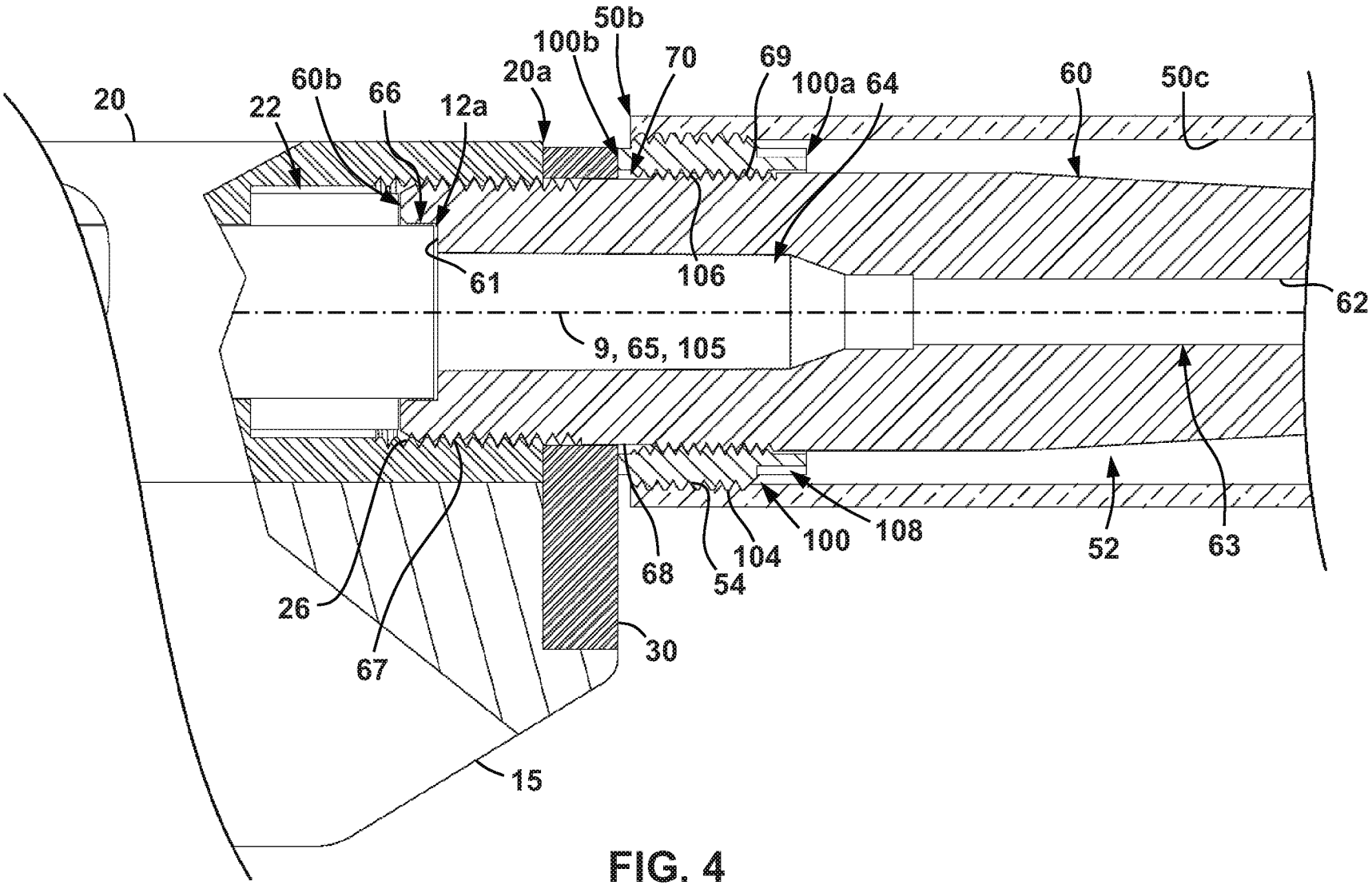
FIG. 4 is an enlarged side, partial cross-sectional view of the rifle of FIG. 1, according to an example embodiment of the present disclosure.

Referring now to FIGS. 2 and 4, receiver 20 includes a first or front end 20*a*, and a second or rear end 20*b* opposite front end 20*a*. In addition, a cavity 22 extends between ends 20*a*, 20*b* that receives the bolt 12 therein during operations. Bolt 12 generally includes a central axis 9, a first or front end 12*a* and a second or rear end 12*b* opposite front end 12*a*. A handle 11 is formed proximate rear end 12*b* that is configured to be manipulated by a user during operations. Bolt 12 is inserted into cavity 22 from rear end 20*b* of receiver 20 such that front end 12*a* is disposed within cavity 22 and handle 11 extends outside of cavity 22 at rear end 20*b* of receiver 20. A slot or port 24 extends through receiver 20 at a position between ends 20*a*, 20*b* into cavity 22 that is to provide an ejection port for spent cartridge shells following the discharge of a projectile. In addition, an internal thread 26 (see FIG. 4) is formed within cavity 22 at (or proximate to) front end 20*a*. As will be described in more detail below, internal thread 26 is configured to threadably engage with a corresponding external thread on barrel 60.

Referring again to FIGS. 1 and 2, handguard 50 is a hollow member that includes a first or front end 50*a*, and a second or rear end 50*b* opposite front end 50*a*. In this embodiment, handguard 50 is a cylindrically shaped tubular member; however, it should be appreciated that handguard may be formed into a wide range of shapes and sizes in other embodiments and may be formed from a wide range of materials. In addition, in some embodiments, handguard 50 may include one or more rails or other attachment features (not shown) to allow for the attachment of other components to handguard 50 during operations (e.g., bi-pods, lasers, lights, scopes, and the like). Referring briefly to FIGS. 1 and 4, handguard 50 includes a throughbore 52 extending axially between ends 50*a*, 50*b* that is defined by a radially inner surface 50*c*. In addition, an internal thread 54 is defined along radially inner surface 50*c* that extends from (or proximate to) rear end 50*b*.

Figure 3:
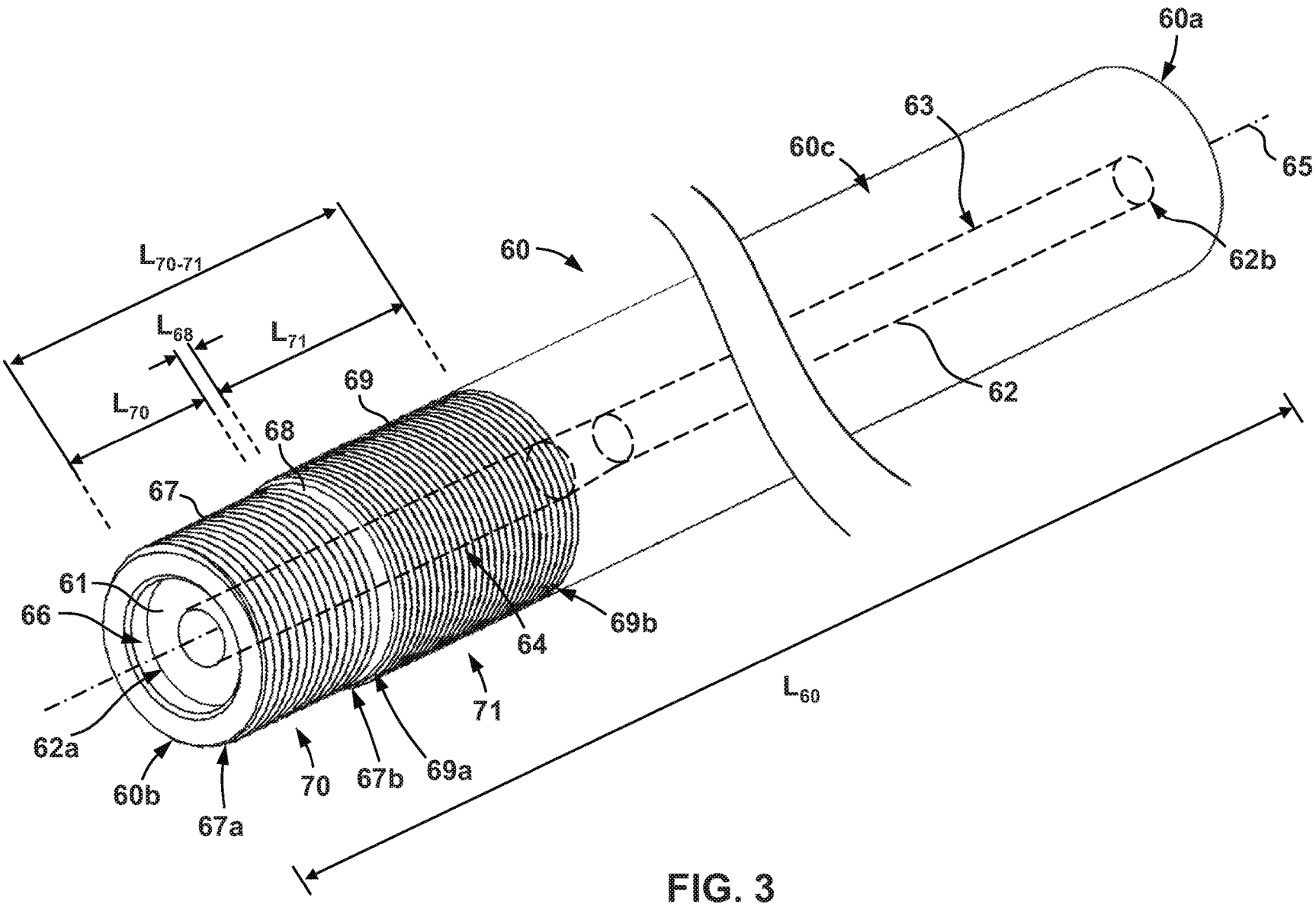
FIG. 3 is a perspective view of the barrel of the rifle of FIG. 1, according to an example embodiment of the present disclosure.

Referring now to FIG. 3, barrel 60 is an elongate tubular member that includes a central or longitudinal axis 65, a first or front end 60*a*, and a second or rear end 60*b* opposite the front end 60*a*. As will be described in more detail below, the rear end 60*b* generally engages with the receiver 20 of rifle 10, and the front end 60*a* extends outward or away from receiver 20 along axis 65. In addition, barrel 60 includes a radially outer surface 60*c* that extends axially from front end 60*a* to rear end 60*b*. Radially outer surface 60*c* may include any shape or cross-section (e.g., polygonal, triangular, cylindrical, frustoconical, or combinations thereof).

In this embodiment, a cylindrical recess 66 extends axially into rear end 60*b* to a radially extending planar terminal surface 61. In addition, a throughbore 62 extends axially from planar terminal surface 61 to front end 60*a*. Throughbore 62 includes a first section 64 extending axially from planar terminal surface 61, and a second section 63 extending axially from first section 64 to second end 60*b*. First section 64 may define a chamber within throughbore 62 that receives a cartridge such that a projectile that is mounted within the cartridge may be extended into second portion 63 of throughbore 62 along axis 65. Thus, in this embodiment, first portion 64 may have an inner diameter that is greater than an inner diameter of the second portion 63. It should be appreciated that in other embodiments, barrel 60 may not include recess 66 and terminal, planar surface 61 may be disposed at rear end 60*b*.

Referring still to FIG. 3, barrel 60 includes a first threaded connector 70 and a second threaded connector 71 disposed along radially outer surface 60*c*. In this embodiment, the first threaded connector 70 is axially spaced from the second threaded connector 71, such that a cylindrical surface 68 extends axially therebetween. It should be appreciated that cylindrical surface 68 may be replaced, in other embodiments, with a differently shaped surface. For example, in some embodiments, threaded connectors 70, 71 may be axially separated by a frustoconical, triangular, rectangular, polygonal, and/or faceted surface.

First threaded connector 70 includes a first external thread 67 and second threaded connector 71 includes a second external thread 69 (and thus, threads 67, 69 may be referred to herein as "external barrel threads"). First thread 67 includes a first end 67*a* and a second end 67*b* axially spaced from the first end 67*a* along axis 65. Second thread 69 includes a first end 69*a* and a second end 69*b* axially spaced from the first end 69*a* along axis 65. First end 67*a* of first thread 67 is axially more proximate to rear end 60*b* of barrel 60 than second end 67*b* of first thread 67 and ends 69*a*, 69*b* of second thread 69, and second end 69*b* of second thread 69 is more proximate to front end 60*a* of barrel 60 than first end 69*a* of second thread 69 and ends 67*a*, 67*b* of first thread 67. Also, cylindrical surface 68 extends axially between second end 67*b* of first thread 67 and first end 69*a* of second thread 69. In this embodiment, first threaded connector 70 extends axially from rear end 60*b* of barrel 60, and thus, first end 67*a* of first thread 67 is disposed at (or proximate to) rear end 60*b*. However, in other embodiments, first threaded connector 70 may extend from a point along barrel 60 that is axially spaced from rear end 60*b* (e.g., such that first end 67*a* is axially spaced from rear end 60*b*).

In some embodiments, first thread 67 is different from second thread 69 in at least one aspect (e.g., such as in pitch, diameter, shape, and the like). For example, in some embodiments (such as, for example, the embodiment of FIG. 3), the major diameter of the first thread 67 is smaller than the major diameter than the second thread 69. As used herein, the major diameter of the first and second threads 67, 69 refers to the diameter of an imaginary coaxial cylinder (e.g., coaxial to barrel 60) that extends along and touches the crests of the corresponding external thread 67, 69. In addition, in this embodiment first threaded connector 70 (particularly first thread 67) is configured to threadably engage with internal thread 26 within receiver 20, whereas second threaded connector 71 (particularly second thread 69) is configured to threadably engage with a corresponding internal thread within a barrel nut (e.g., thread 106 described in more detail below). In some embodiments, first thread 67 of first threaded connector 70 may be substantially the same as second thread 69 of second threaded connector 71, except that threads 67, 69 are axially spaced from one another as previously described.

First threaded connector 70 has an axial length $L_{70}$ that extends axially between ends 67*a*, 67*b* of first thread 67 (e.g., length $L_{70}$ is equal to the axial length of first thread 67). Also, second threaded connector 71 has an axial length $L_{71}$ that extends axially between ends 69*a*, 69*b* of second thread 69 (e.g., length $L_{71}$ is equal to the axial length of second thread 69). Cylindrical surface 68 has an axial length $L_{68}$ that extends axially from second end 67*b* of first thread 67 to first end 69*a* of second thread 69. Further, a total axial length $L_{70\text{-}71}$ that extends axially from first end 67*a* of first thread 67 to second end 69*b* of second thread 69.

In some embodiments, the axial length $L_{70}$ is smaller than the axial length $L_{71}$; however, in other embodiments, the axial length $L_{71}$ may be smaller than the axial length $L_{70}$, or the axial lengths $L_{70}$, $L_{71}$ may be substantially equal. For instance, in some embodiments, the axial length $L_{70}$ may range from about 0.3 inches to about 1.5 inches, or from about 0.6 inches to about 0.9 inches, and the axial length $L_{71}$ may range from about 0.35 inches to about 1.0 inches, or from about 0.5 inches to 1.0 inches. In addition, in some embodiments the length $L_{68}$ of cylindrical surface 68 ranges from about 0.1 inches to about 0.5 inches, or from about 0.15 inches to about 0.35 inches, or from about 0.18 inches to about 0.25 inches. Further, the total axial length $L_{70\text{-}71}$ may be entirely disposed within a first 50% of the total axial length $L_{60}$ of barrel 60 (e.g., the length of barrel 60 along axis 65 between ends 60*a*, 60*b*) from the rear end 60*b*. In some embodiments, the total axial length $L_{70\text{-}71}$ may be entirely disposed within a first 25%, or within a first 10%, or within a first 5% of the total axial length $L_{60}$ of barrel 60 from the rear end 60*b*. Thus, the first threaded connector 70 and the second threaded connector 71 are each disposed more proximate the rear end 60*b* of barrel 60 than the front end 60*a*.

Referring now to FIG. 4, rear end 60*b* of barrel 60 is inserted within cavity 22 at front end 20*a* of receiver 20 such that first thread 67 of threaded connector 70 is threadably engaged with internal thread 26 formed within cavity 22, and central axis 65 of barrel 60 is aligned with a central axis 9 of bolt 12 (when bolt 12 is inserted within cavity 22 as shown). In addition, in this embodiment, front end 12*a* of bolt 12 is configured received within recess 66 and therefore may abut or engage with terminal planar surface 61; however, in other embodiments, front end 12*a* of bolt 12 may not actually engage with planar surface 61 or with any other surface of barrel 60 during operations.

In this embodiment, a bushing or spacer 30 is disposed about barrel 60 and abuts front end 20*a* of receiver 20. Also, a barrel nut 100 (which is described in more detail below) is threadably engaged with second thread 69 of threaded connector 70 of barrel 60 so as to axially compress spacer 30 against front end 20*a* of receiver 20 and to place the section of barrel 60 extending axially from barrel nut 100 to front end 20*a* of receiver 20 in tension. As a result, barrel nut 100 may effectively fix the axial and circumferential position of barrel 60 relative to receiver 20 about axes 65, 9.

Figure 6:
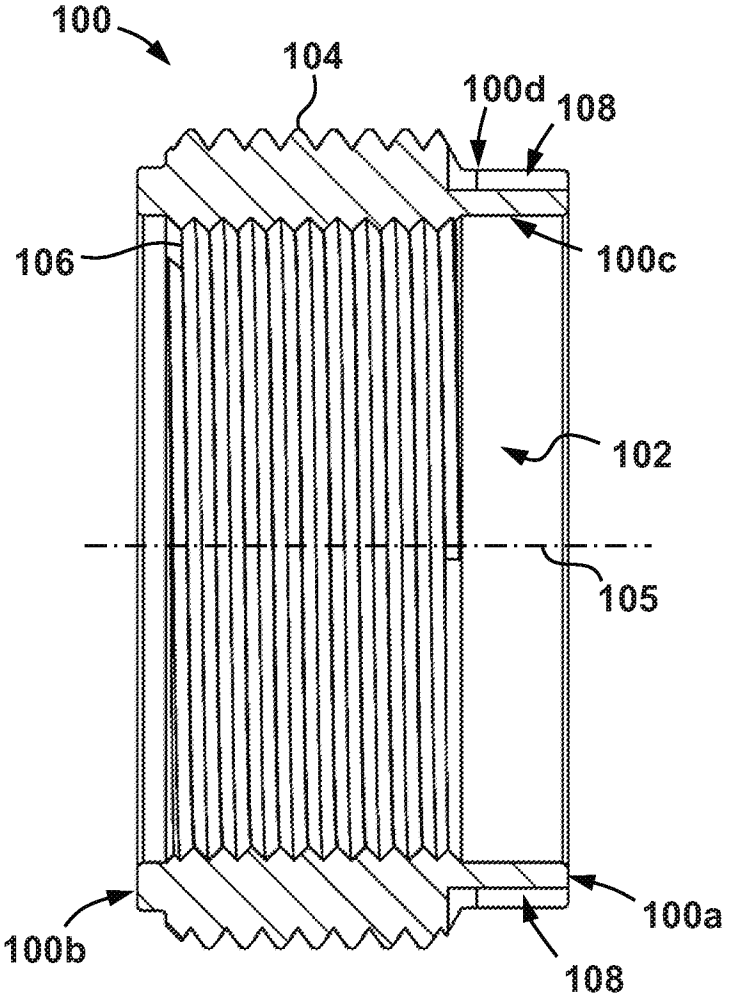
FIG. 6 is a side cross-sectional view of the barrel nut of FIG. 5, according to an example embodiment of the present disclosure.
Figure 5:
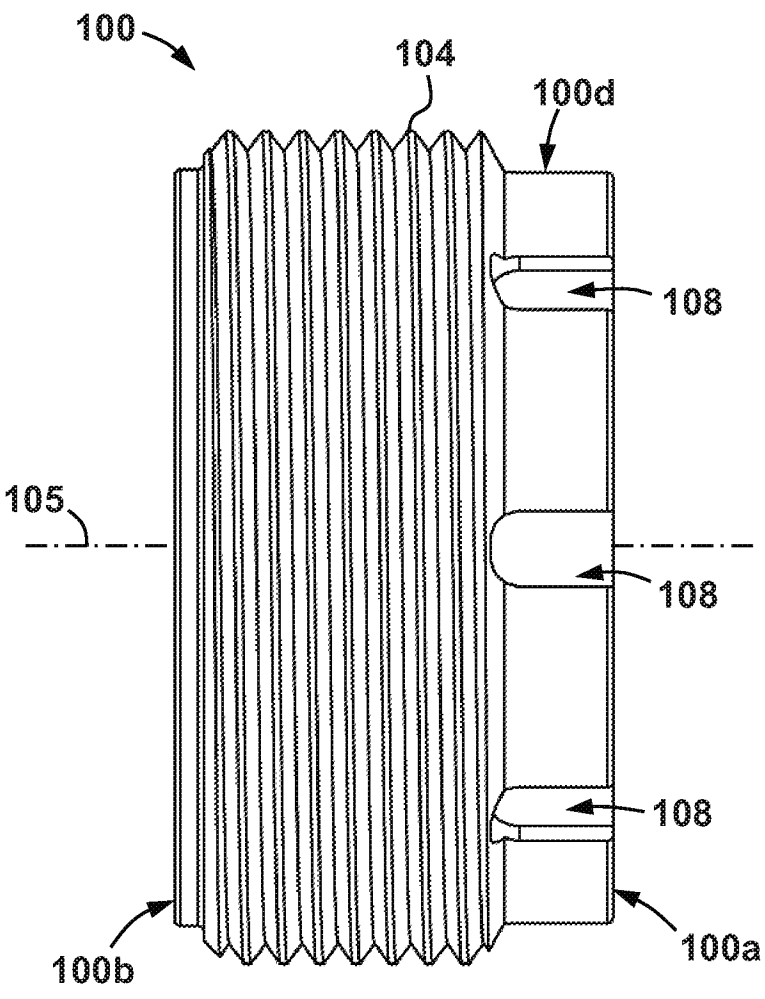
FIG. 5 is a side view of the barrel nut of the rifle of FIG. 1, according to an example embodiment of the present disclosure.

Referring now to FIGS. 5 and 6, barrel nut 100 is a tubular member including a central axis 105, a first or front end 100*a*, and a second or rear end 100*b* opposite front end 100*a*. In addition, barrel nut 100 includes a radially inner surface 100*c* extending axially between ends 100*a*, 100*b* and a radially outer surface 100*d* also extending between ends 100*a*, 100*b*. Radially inner surface 100*c* defines an axially extending throughbore 102, and includes an internal thread 106 that is disposed between ends 100*a*, 100*b*. In this embodiment, internal thread 106 is more proximate rear end 100*b* than front end 100*a*; however, other arrangements are possible. For example in some embodiments, internal thread 106 may be more proximate front end 100*a* than rear end 100*b*, may be equidistant between ends 100*a*, 100*b*, or may extend along substantially the entire length of barrel nut 100 between ends 100*a*, 100*b*.

Radially outer surface 100*d* includes an external thread 104 that is disposed between ends 100*a*, 100*b*. In this embodiment, external thread 104 is more proximate rear end 100*b* than front end 100*a*; however, as was previously explained above for internal thread 106, other arrangements are possible. For example, in some embodiments, external thread 104 may be more proximate front end 100*a* than rear end 100*b*, may be equidistant between ends 100*a*, 100*b*, or may extend along substantially the entire length of barrel nut 100 between ends 100*a*, 100*b*.

In addition, a plurality of recesses 108 extend radially into radially outer surface 100*d* and axially from front end 100*a*. For example, the plurality of recesses extend axially three to four times as much as the plurality of recesses extend radially, such that each of the plurality of recesses forms a rectangular geometric profile. In an embodiment, there are a total of eight recesses 108 that are uniformly circumferentially spaced about axis 105. In other embodiments, the total number of recesses 108 is more, or less, than eight. During operations, recesses 108 provide engagement points along barrel nut 100 for a suitable tool. For example, the user may employ a spanner wrench that is configured to engage with recesses 108 to thus tighten (or loosen) barrel nut 100.

Referring back now to FIG. 4, barrel nut 100 is disposed on barrel 60 such that internal thread 106 is threadably engaged with second thread 69 of second threaded connector 71 and axis 105 of barrel nut 100 is substantially aligned with axes 65, 9. After first threaded connector 71 of barrel 60 (particularly first thread 67) is threadably engaged with internal thread 26 of receiver 20, barrel nut 100 is threadably advanced over second thread 69 toward first end 69*a* (and thus also toward rear end 60*b* of barrel 60) until rear end 100*b* of nut 100 engages or abuts spacer 30. Thereafter, additional torque may be applied to barrel nut 100 about axes 105, 65 to axially compress spacer 30 between front end 20*a* of receiver 20 and rear end 100*b* of barrel nut 100. For example, torque may be applied to barrel nut 100 via the spanner wrench that is engaged with recesses 108 as previously described above. In addition, as barrel nut 100 axially compresses spacer 30, an axially directed load (e.g., tension) is also imparted to the section of barrel 60 extending along axis 65 between barrel nut 100 and front end 20*a* of receiver. As a result, once barrel nut 100 is fully torqued and tightened on second thread 69 of barrel 60, the axial and circumferential position of barrel 60 is fixed relative to receiver 20.

Once barrel nut 100 is fully tightened onto second thread 69 of barrel 60, handguard 50 may be placed axially over barrel 60 such that barrel 60 is received through throughbore 52. Internal thread 54 within handguard 50 may then be threadably engaged with external thread 104 on barrel nut 100. Without being limited to this or any other theory, by providing external thread 104 on barrel nut 100, handguard 50 may be secured to barrel 60 at a position proximate to the connection between barrel 60 and receiver 20 (e.g., at engaged threads 67, 26), while allowing the remainder of barrel 60 to remain free floating relative to handguard 50. In other words, contact is minimized between radially inner surface 50*c* of handguard 50 and radially outer surface 60*c* of barrel 60. In addition, the relatively simple connection provided between barrel nut 100 and handguard 50 allows different handguards (e.g., other than handguard 50) to be easily interchanged on rifle 10 without needing to affect the connection between barrel 60 and receiver 20. Thus, rifle may be more easily customized to a user's preference.

While several of the embodiments disclosed above describe that barrel nut 100 includes external thread 104, such as for engagement with handguard 50, it should be appreciated that barrel nut 100 may, alternatively, be provided without any external threads. In this embodiment, for example, barrel nut 100 is disposed on barrel 60 such that internal thread 106 is threadably engaged with second thread 69 of second threaded connector 71 and axis 105 of barrel nut 100 is substantially aligned with axes 65, 9. Namely, after first threaded connector 71 of barrel 60 (particularly first thread 67) is threadably engaged with internal thread 26 of receiver 20, barrel nut 100 is threadably advanced over second thread 69 toward first end 69*a* (and thus also toward rear end 60*b* of barrel 60) until rear end 100*b* of nut 100 engages or abuts spacer 30. Thereafter, additional torque may be applied to barrel nut 100 about axes 105, 65 to axially compress spacer 30 between front end 20*a* of receiver 20 and rear end 100*b* of barrel nut 100. For example, torque may be applied to barrel nut 100 via the spanner wrench that is engaged with recesses 108 as previously described above. In addition, as barrel nut 100 axially compresses spacer 30, an axially directed load (e.g., tension) is also imparted to the section of barrel 60 extending along axis 65 between barrel nut 100 and front end 20*a* of receiver. As a result, once barrel nut 100 is fully torqued and tightened on second thread 69 of barrel 60, the axial and circumferential position of barrel 60 is fixed relative to receiver 20. In this embodiment, though barrel nut 100 does not include external thread 104, it nonetheless fixes the position of barrel 60. Moreover, barrel nut 100 provides additional material around first section 64, this is beneficial for improved pressure-containment, especially in high-caliber implementations.

Referring now to FIGS. 1, 2, and 4, during operations a user (not shown) may engage grip 13 with a first hand and may either grasp handguard 50 with a second hand and/or may lay or rest handguard upon a suitable support surface. In addition, the user may manipulate bolt 12 (e.g., via handle 11) to load an unfired cartridge into chamber 64 of barrel 60 from a magazine 16, and then may engage the trigger mechanism 14 (e.g., via the first hand) to discharge a projectile from front end 60*a* of barrel 60. During these operations, barrel 60 is coupled to handguard 50 at rear end 60*b* via barrel nut 100 and receiver 20, but is otherwise free from engagement with handguard 50 or any other portion of rifle 10. Thus, rifle 10 may exhibit an enhanced degree of accuracy.

Embodiments disclosed herein have included systems and methods for coupling a barrel and handguard to a firearm that allow the handguard to be interchangeably installed thereon while allowing the barrel to remain free floating (e.g., threaded connectors 70, 270, barrel nut 100). Accordingly, through use of the embodiments disclosed herein, accuracy and customizability of such a firearm are enhanced.

While embodiments disclosed herein have specifically described barrel connection assemblies for use on a chassis-style bolt rifle, it should be appreciated that the disclosed barrel connection assemblies may be utilized on other types of firearms. For example, in some embodiments, the above described barrel connection assemblies may be utilized on a semi-automatic rifle, a lever-action rifle, breach-break rifle, as well as various other types of rifles, shotguns, or handguns. Thus, the description of a chassis-style bolt rifle is only illustrative of one type of firearm that the above described barrel connection assemblies may be utilized with, and should not be interpreted as limiting the potential uses and implementations thereof. In addition, it should be appreciated that some embodiments may not include spacer 30, depending on a variety of factors such as, for example, the design of chassis 15, receiver 20, and the like. Thus, in some of these embodiments, rear end 100*b* of barrel nut 100 may bear directly against front end 20*a* of receiver 20. Further, in some embodiments, handguard 50 may not be threadably engaged with barrel nut 100 (see FIG. 4). Rather, in some of these embodiments, a separate nut (not shown) may be threadably engaged with external threads 104 on barrel nut 100 and handguard 50 may be engaged with and secured to this separate nut (e.g., by slipping the handguard 50 over a smooth outer surface of the separate nut and tightening one or more additional screws or nuts to clamp the handguard 50 onto the separate nut).

While exemplary embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

The invention is claimed as follows:

1. A firearm, comprising:

a receiver comprising a cavity and an internal thread disposed within the cavity;

a barrel comprising a first threaded connector that is threadably engaged with the internal thread within the cavity and a second threaded connector spaced from the first threaded connector; and a barrel nut comprising an internal thread and an external thread, wherein the internal thread of the barrel nut is threadably engaged with the second threaded connector of the barrel.

2. The firearm of claim 1, wherein the barrel comprises a central axis, a first end, and a second end, wherein the first threaded connector and the second threaded connector are each disposed more axially proximate the second end than the first end.

3. The firearm of claim 2, wherein the first threaded connector includes a first axial length and the second threaded connector includes a second axial length, and wherein the first axial length is different from the second axial length.

4. The firearm of claim 2, wherein the first threaded connector has a first external barrel thread, and the second threaded connector has a second external barrel thread, wherein the first external barrel thread is different from the second external barrel thread.

5. The firearm of claim 4, wherein the first external barrel thread has a first major diameter and the second thread has a second major diameter, wherein the first major diameter is smaller than the second major diameter.

6. The firearm of claim 5, further comprising a cylindrical surface extending axially from the first external barrel thread of the first threaded connector to the second external barrel thread of the second threaded connector.

7. The firearm of claim 1, wherein the barrel nut comprises a first end and a second end opposite the first end, wherein the internal thread of the barrel nut is more proximate the second end than the first end.

8. The firearm of claim 7, wherein the external thread of the barrel nut is more proximate the second end than the first end.

9. The firearm of claim 8, wherein the barrel nut further comprises a plurality of circumferentially spaced recesses extending radially inward to a radially outer surface of the barrel nut.

10. The firearm of claim 9, wherein the recesses extend axially from the first end of the barrel nut.

11. The firearm of claim 1, further comprising a handguard disposed about the barrel and including an internal thread that is threadably engaged with the external thread of the barrel nut.

12. A firearm, comprising:

a receiver comprising a cavity and an internal thread disposed within the cavity;

a barrel comprising a first threaded connector that is threadably engaged with the internal thread within the cavity and a second threaded connector, wherein the first threaded connector comprises a first external barrel thread, and the second threaded connector comprises a second external barrel thread that is different from the first external barrel thread; and a barrel nut comprising an internal thread, wherein the internal thread of the barrel nut is threadably engaged with the second threaded connector of the barrel.

13. The firearm of claim 12, wherein the barrel comprises a central axis, a first end, and a second end, wherein the first threaded connector and the second threaded connectors are each disposed more axially proximate the second end than the first end.

14. The firearm of claim 13, wherein the first threaded connector includes a first axial length and the second threaded connector includes a second axial length, and wherein the first axial length is different from the second axial length.

15. The firearm of claim 13, wherein the first external barrel thread has a first major diameter and the second thread has a second major diameter, wherein the first major diameter is smaller than the second major diameter.

16. The firearm of claim 15, wherein the barrel nut comprises a first end and a second end opposite the first end of the barrel nut, wherein the internal thread of the barrel nut is more proximate the second end of the barrel nut than the first end of the barrel nut.

17. The firearm of claim 16, wherein the barrel nut further comprises a plurality of circumferentially spaced recesses extending radially inward to a radially outer surface of the barrel nut, and extending axially from the first end of the barrel nut.

* * * * *